United States Patent [19]

Begley

[11] Patent Number: 4,813,560

[45] Date of Patent: Mar. 21, 1989

[54] SPRING HINGE FOR DISPENSING CAP

[75] Inventor: Douglas G. Begley, Palatine, Ill.

[73] Assignee: Continental White Cap, Inc., Northbrook, Ill.

[21] Appl. No.: 190,085

[22] Filed: May 4, 1988

[51] Int. Cl.[4] ..... B65D 43/14

[52] U.S. Cl. ..... 215/235; 220/339; 222/517; 222/546

[58] Field of Search ..... 215/235, 237; 220/339, 220/335, 375, 254; 222/517, 546; 16/225, 227

[56] References Cited

U.S. PATENT DOCUMENTS

| | | | |
|---|---|---|---|
| Re. 30,861 | 2/1982 | Krawagna . | |
| 3,289,877 | 12/1966 | Wolf . | |
| 3,618,161 | 11/1971 | Nozawa . | |
| 3,629,901 | 12/1971 | Wolf et al. . | |
| 4,124,151 | 11/1978 | Hazard . | |
| 4,158,902 | 6/1979 | Chernack et al. . | |
| 4,291,818 | 9/1981 | Nozawa et al. . | |
| 4,346,810 | 8/1982 | Kneissl . | |
| 4,403,712 | 9/1983 | Wiesinger . | |
| 4,414,705 | 11/1983 | Ostrowsky . | |
| 4,487,324 | 12/1984 | Ostrowsky . | |
| 4,503,991 | 3/1985 | Joyce . | |
| 4,545,495 | 10/1985 | Kinsley . | |
| 4,573,600 | 3/1986 | DuBach . | |
| 4,625,898 | 12/1986 | Hazard . | |
| 4,669,622 | 6/1987 | Bennett . | |
| 4,711,360 | 12/1987 | Ullman | 215/235 |
| 4,727,999 | 3/1988 | Gach | 215/235 |
| 4,759,455 | 7/1988 | Wilson | 215/235 |

*Primary Examiner*—George T. Hall

*Attorney, Agent, or Firm*—Charles E. Brown; Paul Shapiro; Charles A. Brown

[57] ABSTRACT

This relates to a dispensing cap including a cap body and a cover which are connected together by suitable hinges so that the cover may swing between a fully open position and a fully closed position. In association with the hinges, there is a strap which connects a bendable wall portion of the cover to the cap body. The strap, in the open position of the cover, is located on one side of hinge centers and as the cover is swung towards a closed position, the strap passes through an overcenter position where a greater length of strap is required, thus effecting bending of the cover wall portion between the hinges to provide a spring effect. In the closed position of the cover, the strap is on the other side of the hinge center and bending of the cover wall portion is held to a minimum.

14 Claims, 1 Drawing Sheet

SPRING HINGE FOR DISPENSING CAP

This invention relates in general to new and useful improvements in dispensing caps which include a cap body and a cover connected together by a hinge and wherein there is a spring mechanism which acts to hold the cover in fully open and fully closed positions.

Dispensing caps of this broad type are generally known and may be divided into several broad classes. U.S. Pat. Nos. 4,193,519 and 4,638,916 disclose a spring of the stretch-strap type. On the other hand, springs in the form of elbow-shaped flexible straps are broadly disclosed in U.S. Pat. Nos. 3,289,877; 3,512,227; 3,594,852; 3,628,215; 3,629,901; 3,720,979; 3,933,271; 4,047,495; 4,172,540; 4,346,810; 4,386,714 and 4,414,705.

Other types of spring structure include a deforming cover as disclosed in U.S. Pat. No. 4,377,247 and caps having a freestanding mast as disclosed in U.S. Pat. Nos. 4,220,248 and 4,244,495.

Most specifically, in accordance with this invention, the dispensing cap is formed of a cap body and cover which are connected together by a pair of widely spaced living hinges or side hinges. A narrow strap in the center between the hinges also connects the cover to the cap body, but its mounting points are located so as to make the strap become "too short" during foldover in relation to the distance between its mounting points. The strong strap sizing and the spacing between the side hinges create an area at the cover rear which is forced to bend during foldover. The strap pulls at the rear of the cover so that this portion of the cover becomes a spring to store energy.

With the above and other objects in view that will hereinafter appear, the nature of the invention will be more clearly understood by reference to the following detailed description, the appended claims, and the several views illustrated in the accompanying drawing.

Figure 1:
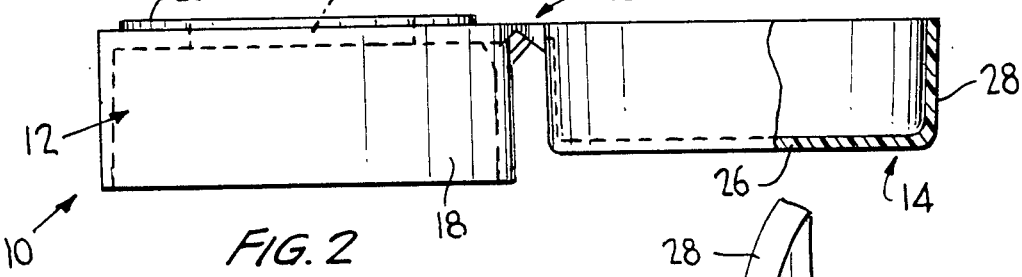
FIG. 1 is a side elevational view of a dispensing cap formed in accordance with this invention with portions broken away and shown in section, the cap being in its as-molded open state.
Figure 2:
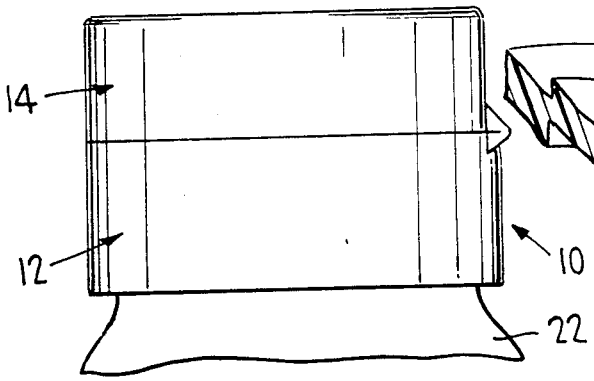
FIG. 2 is a side elevational view of the dispensing cap of FIG. 1 in its closed state and mounted on a container.

Referring now to the drawing in detail, it will be seen that it is illustrated in FIGS. 1 and 2 the dispensing cap which is the subject of this invention, the cap being generally identified by the numeral 10. The dispensing cap 10 includes a cap body 12 and a cover 14. The cover 14 is hingedly connected to the cap body 12 y a combination hinge and spring strap arrangement generally identified by the numeral 16.

The cap body 12 includes a skirt portion 18 which is partially closed at its upper end by a projecting end structure 20. It is to be understood that the skirt 18 will be provided internally with suitable means (not shown) such as threads for fixing the cap body 12 to a neck finish (not shown) of a conventional container 22.

It is to be understood that the end structure 20 of the cap body 12 will be provided with a dispensing opening 24 which is to be closed by the cover 14.

With respect to the cover 14, basically it includes an end panel 26 and a skirt 28. The cap body skirt 18 is cylindrical and the same is generally true of the cover skirt 28. However, as is best illustrated in FIG. 3, the skirt 28 preferably has a planar portion 30 which in the as-molded state of the dispensing cap 10, faces the cap body 12.

Figure 3:
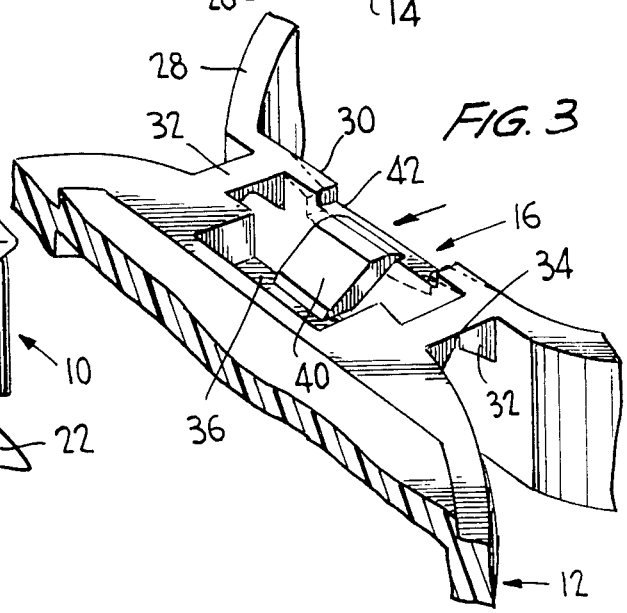
FIG. 3 is an enlarged fragmentary perspective view showing specifically the hinge and spring connection between the cover and the cap body.
Figure 4:
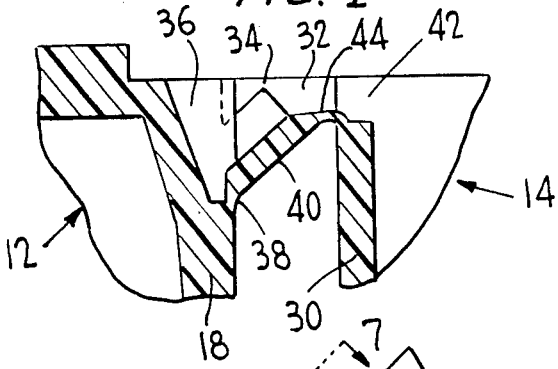
FIG. 4 is an enlarged fragmentary vertical sectional view taken through the strap and showing specifically the relationship of the strap with respect to the hinge in the open state of the cap.

The hinge and strap assembly 16, as is best shown in FIG. 3, includes a pair of widely spaced hinges 32 which are of the inverted V-shaped notched type having a thin central portion 34 which defines a hinge center. The hinge centers 34 are aligned parallel to the planar wall portion 30.

The cap body 12, generally opposing the planar wall portion 30, is provided with a wide notch 36 and at the base of that notch, a thin bendable portion 38 of a strap 40 is integrally connected to the skirt 18. The planar wall portion 30 is also provided with a notch 42 in the upper edge thereof. The notch 42 is shallow as compared to the notch 36. The strap 40 has a thin connecting portion 44 which is integrally connected to the planar wall portion 30 at the base of the notch 42.

Figure 5:
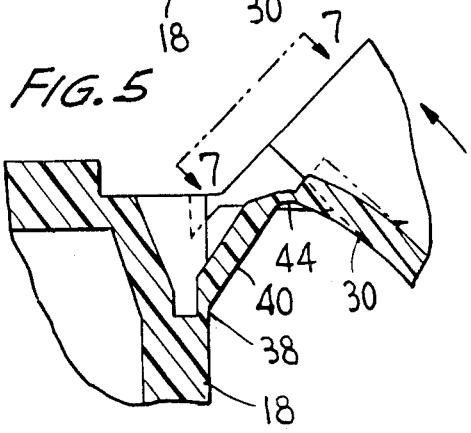
FIG. 5 is a sectional view similar to FIG. 4 showing the cap being moved towards a closed position with the strap being tensioned and bending a portion of the cover.
Figure 7:
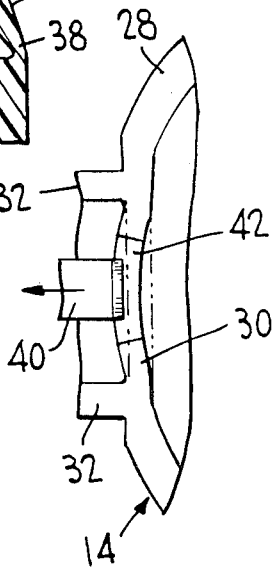
FIG. 7 is a fragmentary plan view taken generally along the line 7—7 of FIG. 5 and shows specifically the bending of the cover between the hinges.

In the fully open, as molded, position of the cover 14, the strap 40 freely extends between the upper portion of the skirt 18 and the then upper portion of the planar wall portion 30. At this time the strap 40 is below the hinge center 34. However, as the cover 14 is pivoted towards a closed position, the point of connection between the strap 40 and the planar wall portion 30 moves away from the connection between the strap 40 and the cap body skirt 18 as is best shown in FIG. 5. This results in the strap 40 being tensioned and the tensioning of the strap 40 pulling on the central portion of the planar wall portion 30 and bending the same. This results in the setting up of a spring action The bending of the planar wall portion 30 is best shown in FIG. 7.

When the strap 40 reaches an overcenter position, the connection between the strap 40 and the planar wall portion 30 begins to move towards the connection between the strap 40 and the skirt 18. Thus the bending and spring action of the planar wall portion 30 decreases until the cover 14 is in its fully closed position of FIG. 6 at which time the tension in the strap 40 is only minimal.

It is also to be noted that the strap 40 is now positioned within the notch 36. It is also to be most particularly noted that the hinge centers 34 are disposed laterally outwardly of the cap body 12 and cover 14 at all times, although the projection relative to the cap body may be held to a minimum.

Figure 6:
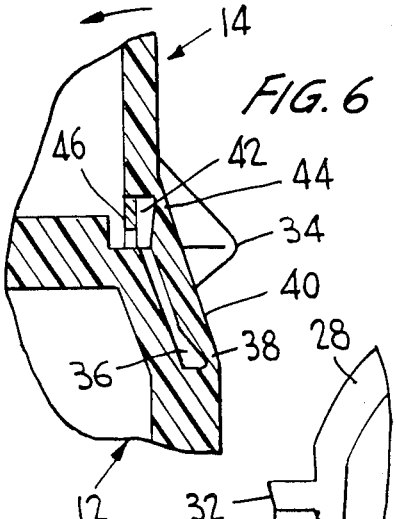
FIG. 6 is another sectional view similar to FIG. 4 showing the cover in its closed position.

Finally, it is to be noted that if desired the notch 42 may have an inner barrier portion 46 as is shown only in FIG. 6. In conjunction with the barrier portion 46, it is to be noted that since the strap mount on the cover is located very low, water spray cooling, used on hot-filled products, cannot easily find entry to the interior of the dispensing cap 10. The barrier 46 closes off even the small notch 42.

It is to be particularly noted that the strap does not stretch in that the stretching action of a strap is poorly suited for certain plastics, including polypropylene from which the dispensing cap 10 is preferably formed.

In conclusion, it is pointed out that the strap 40 is carefully located in that its unique angle and position quickly maximizes perpendicular pulling forces on the cover wall during foldover, minimizing strap overstress. Pulling at the strap at right angles to the cover wall transfers the force in a direct manner, but as the angle of pull decreases, it takes more pull to move the resisting wall. Finally, at a nearly parallel pull the wall will not budge regardless of force. Accordingly, potential strap overstress is minimized by having the strap near a right angle as the cover reaches maximum force during the flip neutral point.

The reversed appearance of the strap manages to keep the strap at about 30 degrees off perpendicular at the neutral point, pulling a flexible wall with large deflections. This compares with 45–85 degrees off in typical stretch-strap designs, using rigid mounts and very small amounts of stretch.

Although only a preferred embodiment of the dispensing cap has been specifically illustrated and described herein, it is to be understood that minor variations may be made in the dispensing cap without departing from the spirit and scope of the invention as defined by the appended claims.

I claim:

1. A dispensing cap comprising a cap body and an integrally molded cover, said cover being connected to said cap body by a pair of spaced hinges separated at said cover by a cover wall portion, and a strap extending between said cap body and said cover wall portion, the relationship between said hinges and said strap being one wherein as said cover moves between open and closed positions said strap is tensioned to temporarily deform said cover wall portion to function as a spring.

2. A dispensing cap according to claim 1 wherein said hinges have centers laterally spaced from both said cap body and said cover.

3. A dispensing cap according to claim 2 wherein in an open position of said cover, said strap is located outwardly of said hinge centers and in a closed position of said cover said strap is located inwardly of said hinge centers.

4. A dispensing cap according to claim 1 wherein connections between said strap and each of said cap body and said cover are thin hinge connections whereby said strap bends relative to both said cap body and said cover.

5. A dispensing cap according to claim 1 wherein said strap connects to said cover axially beyond said hinges.

6. A dispensing cap according to claim 1 wherein said cap base is notched to receive said strap in a closed position of said cover.

7. A dispensing cap according to claim 2 wherein said cover wall portion between said hinges is planar.

8. A dispensing cap according to claim 2 wherein in a closed position of said cap said strap extends axially and radially inwardly.

9. A dispensing cap according to claim 1 wherein said strap is narrow as compared to the spacing between said hinges where said cover wall portion is free to deform.

10. A dispensing cap according to claim 1 wherein said strap is a constant length connector.

11. A dispensing cap according to claim 1 wherein said cover wall portion is notched in alignment with said strap for receiving a portion of said strap in the closed position of said cover.

12. A dispensing cap according to claim 6 wherein said cover wall portion is notched in alignment with said strap for receiving a portion of said strap in the closed position of said cover.

13. A dispensing cap according to claim 2 wherein said cover wall portion between said hinges is planar while said cap body is curved between said hinges.

14. A dispensing cap according to claim 1 wherein tension in said strap is minimal in the closed position of said cover.

* * * * *